US011375808B1

(12) United States Patent
Dawson et al.

(10) Patent No.: US 11,375,808 B1
(45) Date of Patent: Jul. 5, 2022

(54) TABLE DIVIDING SYSTEM AND METHOD OF USE

(71) Applicants: Dony Dawson, Fort Worth, TX (US); Stephen Savoie, Fort Worth, TX (US)

(72) Inventors: Dony Dawson, Fort Worth, TX (US); Stephen Savoie, Fort Worth, TX (US)

( * ) Notice: Subject to any disclaimer, the term of this patent is extended or adjusted under 35 U.S.C. 154(b) by 0 days.

(21) Appl. No.: 16/893,068

(22) Filed: Jun. 4, 2020

(51) Int. Cl.
*A47B 83/00* (2006.01)

(52) U.S. Cl.
CPC ..... *A47B 83/001* (2013.01); *A47B 2200/12* (2013.01); *A47B 2220/0036* (2013.01)

(58) Field of Classification Search
CPC ..... A47B 83/001; A47B 2200/12; A47B 2220/0036
USPC ..... 108/60
See application file for complete search history.

(56) References Cited

U.S. PATENT DOCUMENTS 905,965 A * 12/1908 Wilde ..... A47B 13/003 108/28
1,800,075 A * 4/1931 Imrie ..... A47F 5/005 312/140.3
2,125,747 A * 8/1938 Zadck ..... A47F 5/005 312/140
2,683,010 A * 7/1954 Hamerslag, Jr. ..... B65D 19/385 108/53.5
2,694,614 A * 11/1954 Dent ..... A47B 83/001 312/196
3,913,289 A * 10/1975 Recker ..... F16B 5/0607 312/140
3,986,461 A * 10/1976 Steele ..... A47F 3/142 108/60
4,616,571 A * 10/1986 Lange ..... A47B 47/0033 108/60
5,890,782 A * 4/1999 Alberts ..... A47B 17/00 312/196
6,132,018 A * 10/2000 McGrath ..... A47F 3/007 248/398
6,427,609 B1 * 8/2002 Grant ..... E04H 1/1255 108/60
7,040,723 B2 * 5/2006 Matus, Jr. ..... A47F 10/06 312/137
D560,072 S * 1/2008 Willis ..... D6/332
7,895,953 B2 * 3/2011 Matus, Jr. ..... A47F 10/06 108/27
8,936,223 B1 * 1/2015 McGrath ..... F16C 11/103 248/219.4
9,010,883 B2 * 4/2015 Scott ..... A47F 10/06 312/137
9,144,329 B1 * 9/2015 McGrath ..... A47F 3/12
2011/0193453 A1 * 8/2011 Matus, Jr. ..... A47F 10/06 312/140.4

* cited by examiner

*Primary Examiner* — Daniel J Troy
*Assistant Examiner* — Timothy M Ayres
(74) *Attorney, Agent, or Firm* — Leavitt Eldredge Kaw Firm

(57) ABSTRACT

A table dividing system includes a connecting system to rest on a top surface of a table, the connecting system having a first bracket having a first portion and a second portion with one or more pre-drilled holes; and one or more connectors to extend through the pre-drilled holes; the first portion and the second portion secure to a panel; and the panel is held above the top surface of the table.

5 Claims, 8 Drawing Sheets

TABLE DIVIDING SYSTEM AND METHOD OF USE

BACKGROUND

1. Field of the Invention

The present invention relates generally to table top dividing systems, and more specifically, to a table dividing system that is removable from the table, thereby providing for easy cleaning, limited damage to the table, and easy installation.

2. Description of Related Art

Table top dividing systems are well known in the art and are effective means to place a panel or other divider on the table. Conventional systems require clamping to the sides of a table or drilling into the table top, thereby causing damage. In addition, most systems are meant only for a specific thickness of panel and type of material, and therefore are not suitable for durable and heaver panels.

Accordingly, it is desirable and an objective of the present invention to provide a table dividing system that is removable from a table top and supports durable panels.

Accordingly, although great strides have been made in the area of table top dividing systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
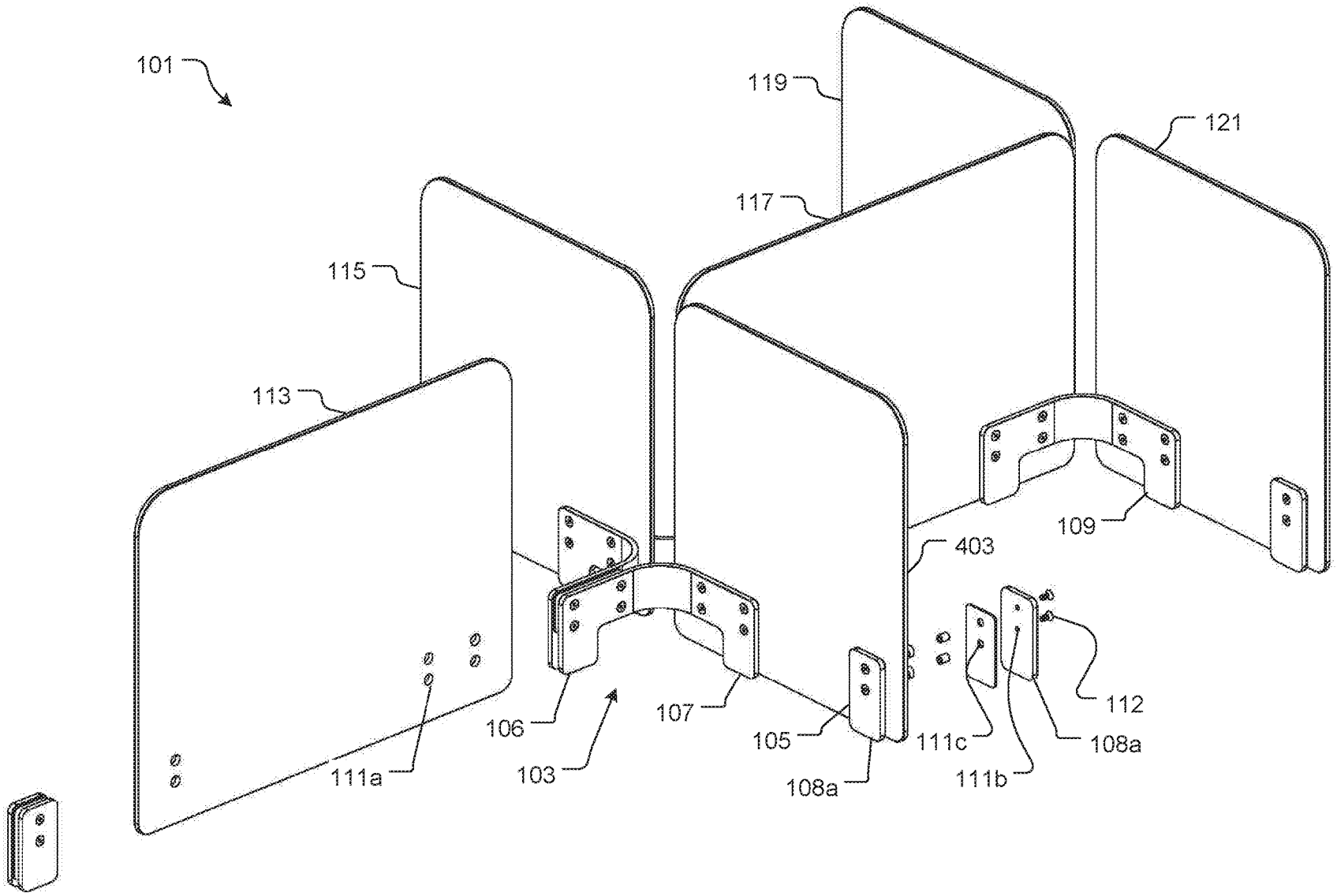
FIG. 1 is an isometric view of a table divider system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional table divider systems. Specifically, the present invention provides for a table divider system that is removable from a table, can be configured for any style and shape of table, and is suitable for durable panels. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts an isometric view of a first embodiment of a table divider system 101 in accordance with a preferred embodiment of the present application. It will be appreciated that system 101 overcomes one or more of the above-listed problems commonly associated with conventional table divider systems.

In the contemplated embodiment, system 101 includes a connecting system 103 that is composed of solid steel in the preferred embodiment. The connecting system 103 includes a plurality of brackets 105, 107, 109 configured to rest on a top surface of a table and receive panels therein. As shown, the plurality of brackets may vary, for example, brackets 107 and 109 demonstrate corner brackets that allow for two panels to engage at 90 degree angles. Bracket 105 is a single bracket configured to support an end of one of the panels between a first portion 108*a* and a second portion 108*b*. As further shown, the brackets include a foot portion 106 which will engage with a top surface of the table and hold the panels above said table.

As shown, the connecting system 103 further includes a plurality of pre-drilled holes 111*a-c* to engage with connection devices 112, such as screws, bolts, or the like, thereby securing a plurality of panels 113, 115, 117, 119, 121, 123 to the brackets. In the preferred embodiment, the plurality of panels are composed of a durable glass, thereby providing for a system that is durable and long lasting.

It should be appreciated that one of the unique features believed characteristic of the present application is the connecting system with the plurality of brackets. As shown, the plurality of brackets secure to the panels in such a way that the panels do not come into contact with the table top. This feature helps ensure that the table and the panel are not damaged. Further, the use of a heavy material, such as steel, acts as a counterweight to the panels, thereby ensuring stability and eliminating the need to secure the panels directly to the table.

Figure 2:
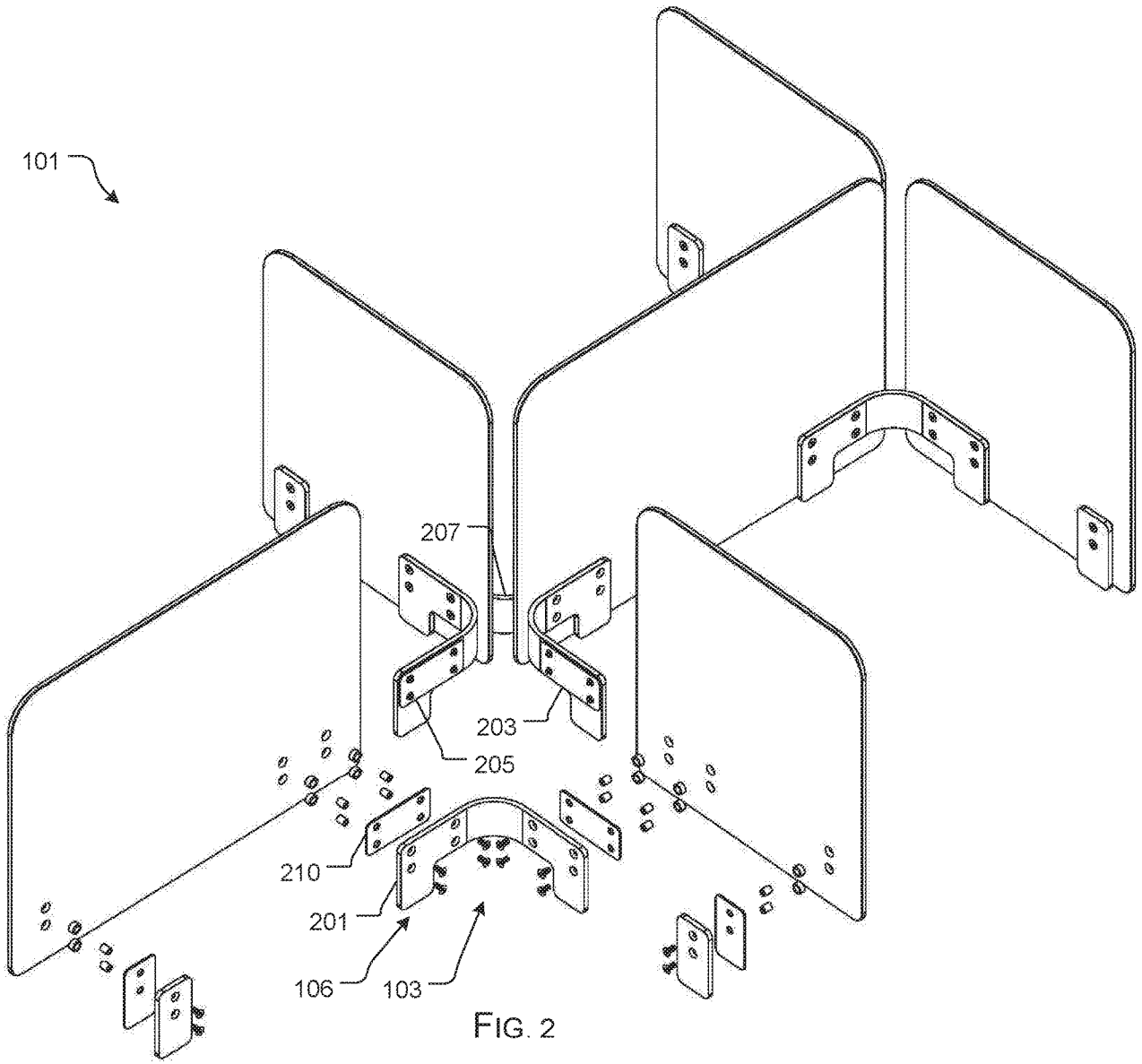
FIG. 2 is an isometric view of a table divider system in accordance with a preferred embodiment of the present application.

In FIG. 2, details of connecting system 103 are further shown with respect to a centralized bracket 107. As shown, this bracket includes first 201, second 203, third 205, and fourth 207 90 degree sections that come together in a central region (see FIG. 1) to engage together. Each of the 90 degree sections includes pre-drilled holes to allow for easy securing to the plurality of panels. This particular configuration allows for four panels to be secured together as shown in the figure. Further, as previously discussed, the brackets include feet 106 that suspend the panels above a table top surface. In some embodiments, inserts 210 can be used to increase the thickness between the bracket sides, thereby allowing for panels of various thicknesses to be used. In the preferred embodiment, the inserts are clear, however it is contemplated that alternative colors can be used.

Figure 3:
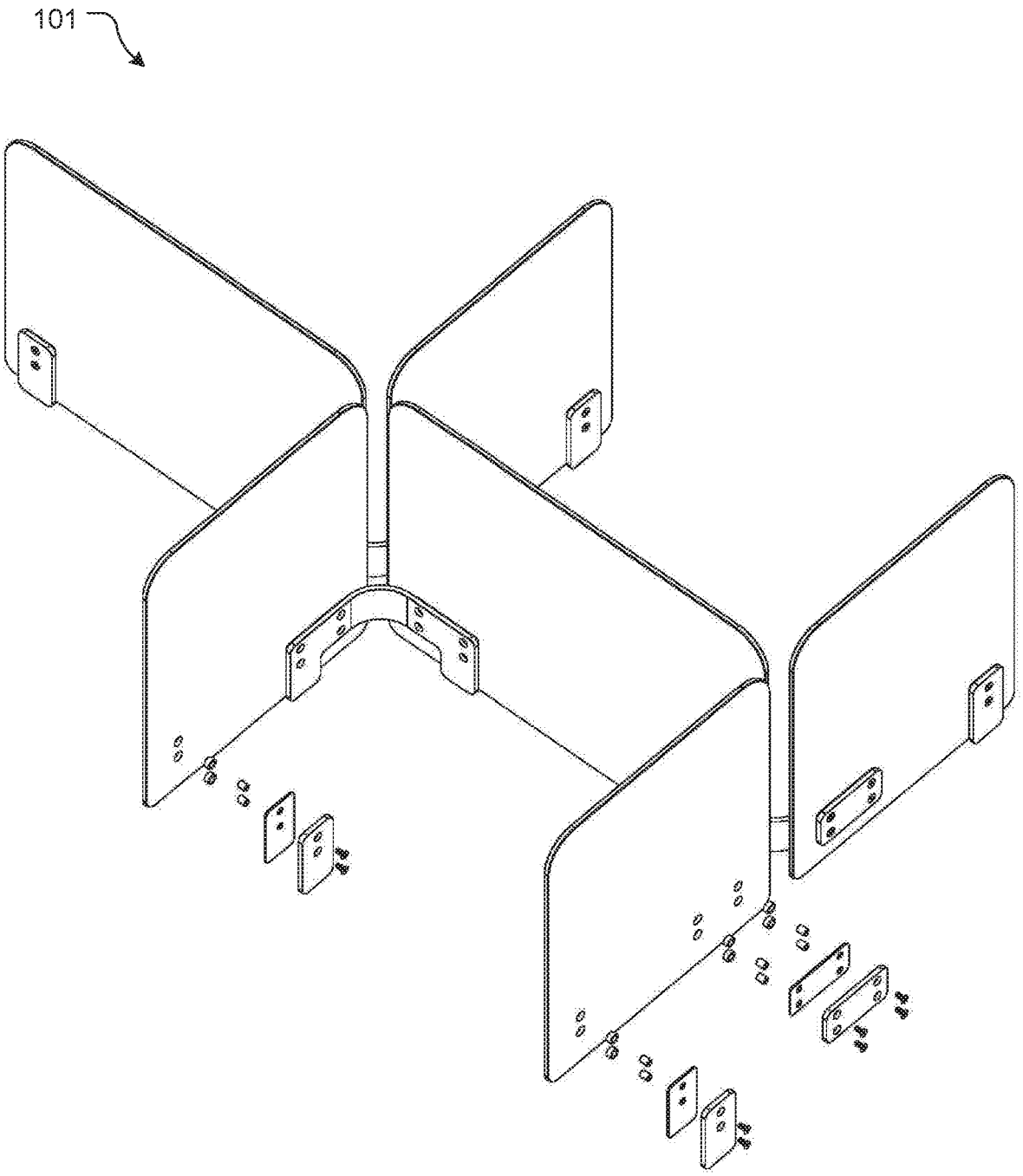
FIG. 3 is an isometric view of a table divider system in accordance with a preferred embodiment of the present application.
Figure 4:
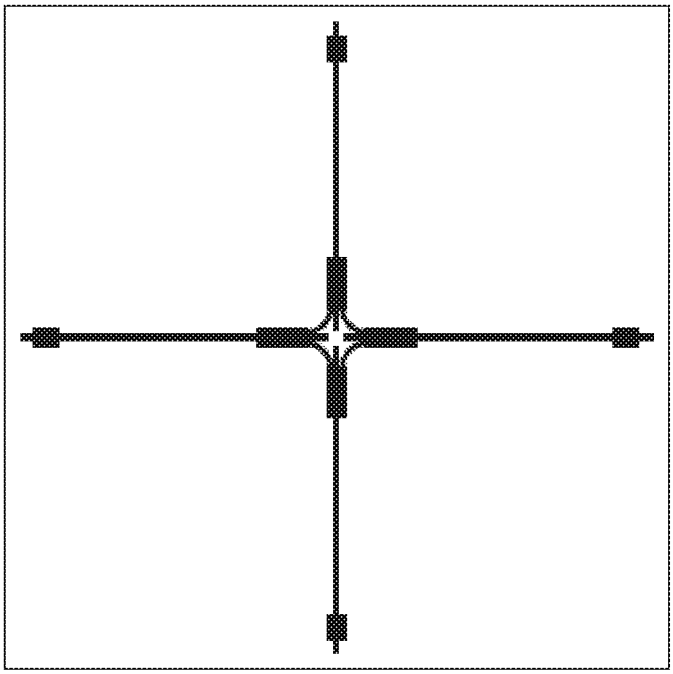
FIG. 4 is a top diagram depicting an arrangement of panels in a square configuration.
Figure 5:
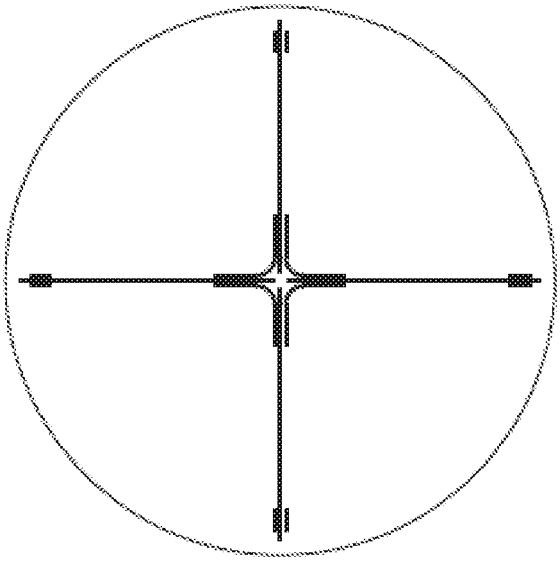
FIG. 5 is a top diagram depicting an arrangement of panels suitable for a round table.
Figure 6:
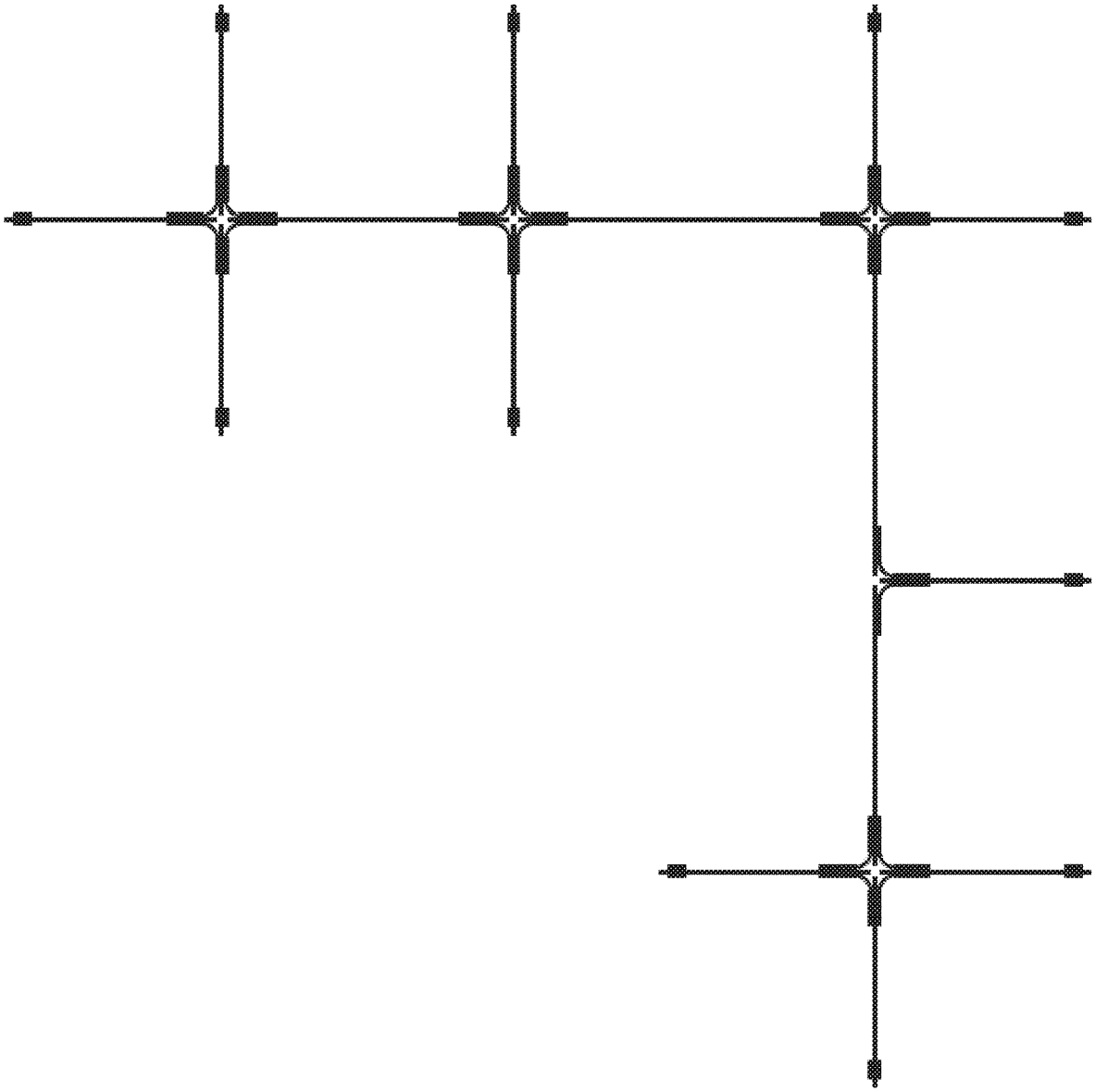
FIG. 6 is a top diagram depicting an arrangement of panels with a corner.
Figure 7:
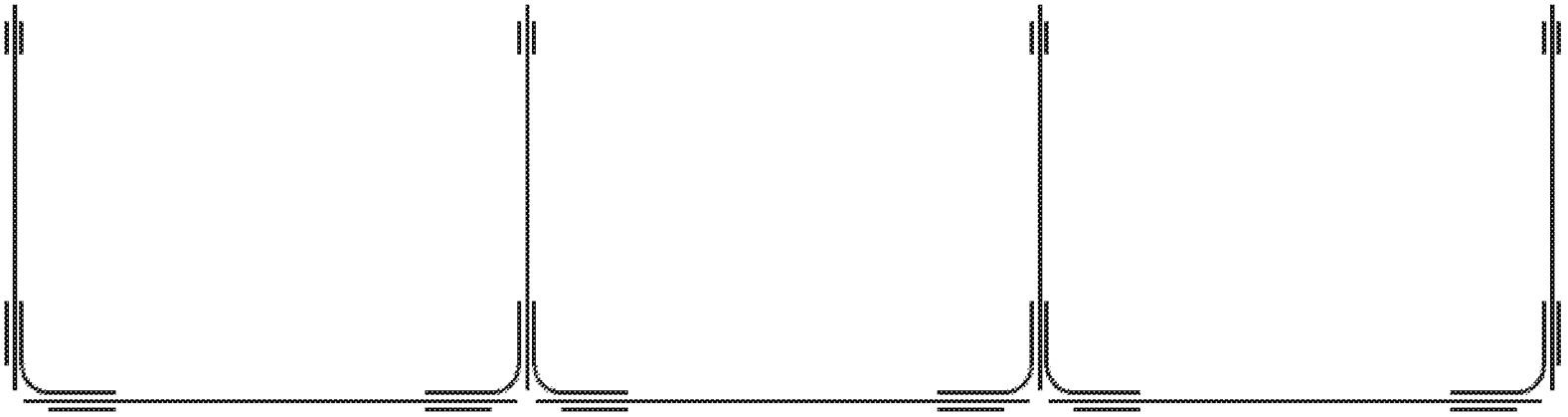
FIG. 7 is a top diagram depicting an arrangement of panels all to one side.

In FIG. 3, another angle of system 101 is shown for clarity.

In FIGS. 4 through 7, a plurality of configurations are shown from a top view. These figures demonstrate the plurality of available configurations that can be created with the connection system and a plurality of panels. The system of the present invention can be adapted for use with tables of various shapes and sizes.

Figure 8:
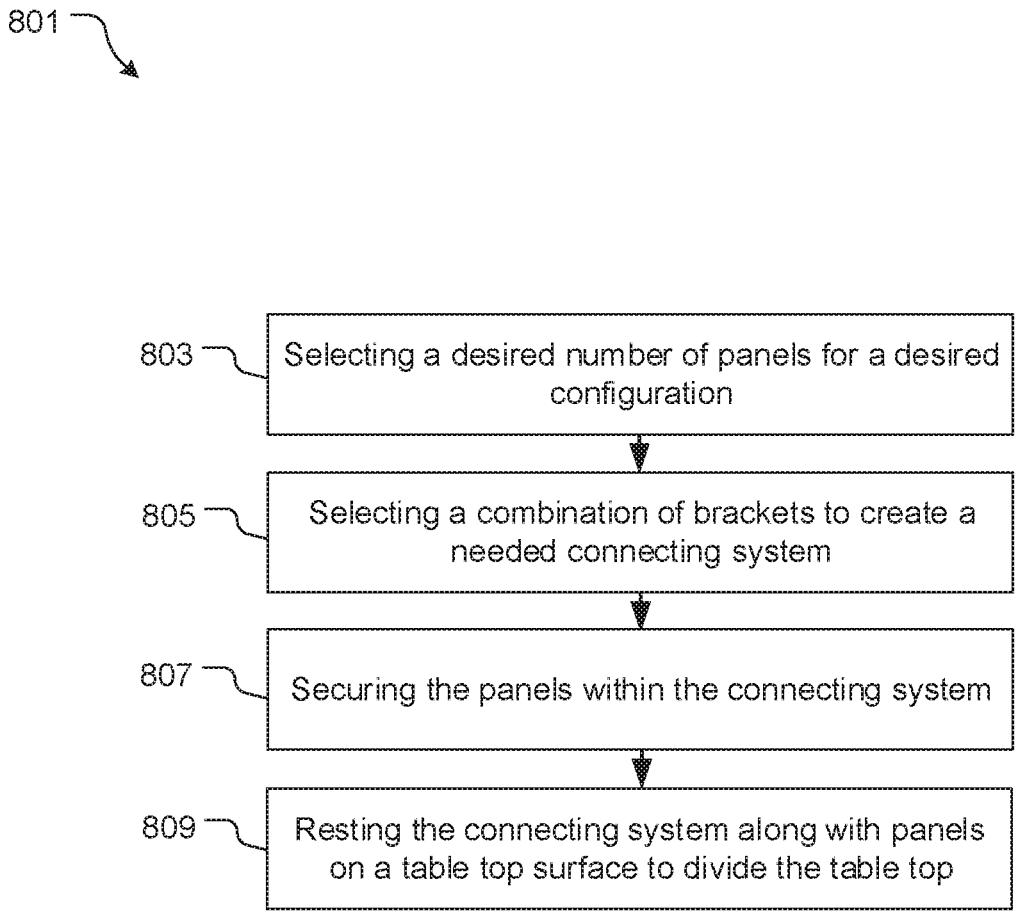
FIG. 8 is a flowchart of a method of use of the systems of the present invention.

In FIG. 8, a flowchart 801 depicts a method of use of the system of the present invention. During use, the user will select the desired number and configuration of panels and a corresponding connection system, as shown with boxes 803, 805. The user will then secure the connection system brackets to the plurality of panels, as shown with box 807. The entire system can then rest on a table top without being permanently secured to the table top, as shown with box 809.

Figure 9:
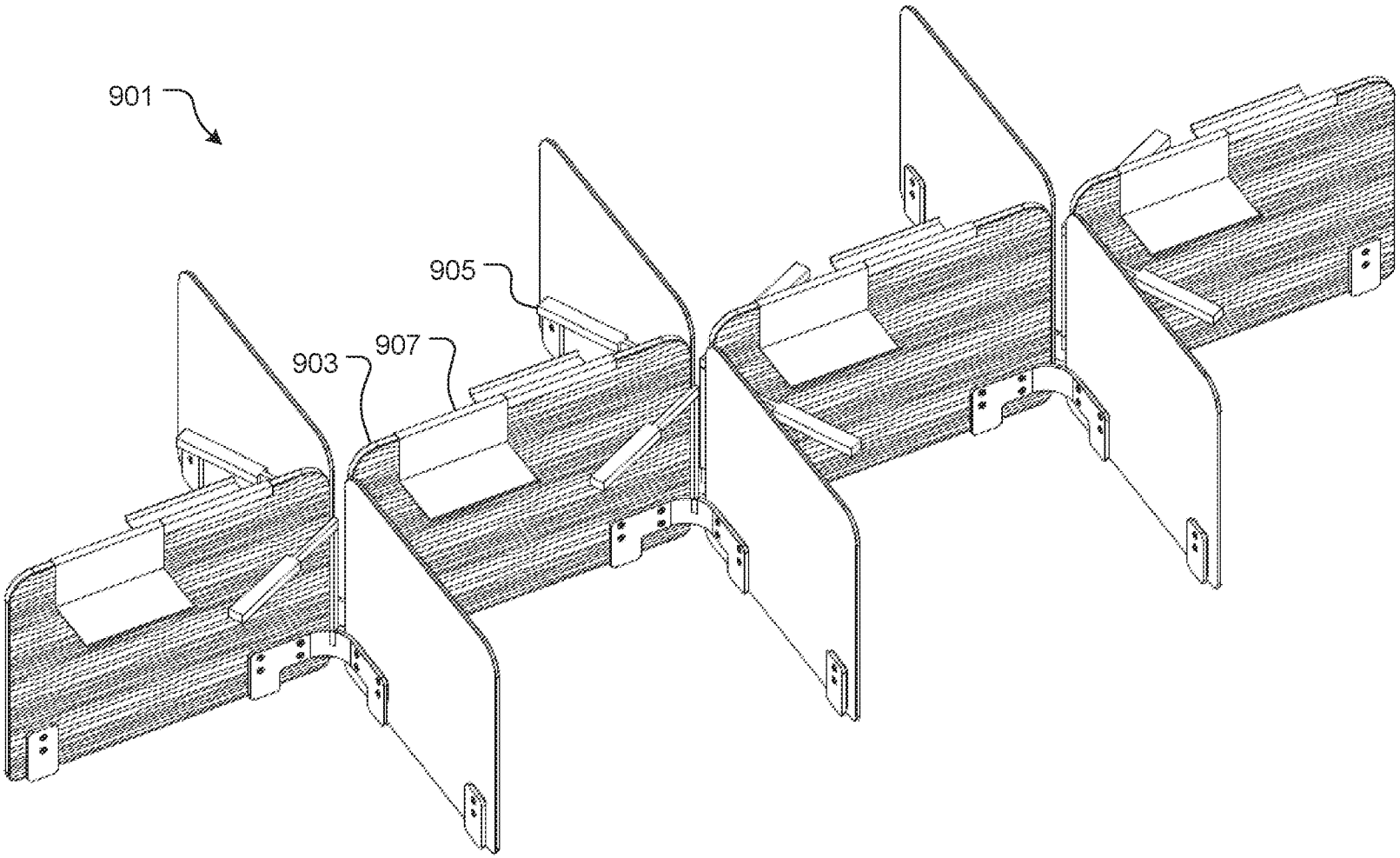
FIG. 9 is an isometric view of an alternative embodiment of a table divider system in accordance with the present application.

In FIG. 9, an alternative embodiment of a table divider system 901 is shown, wherein the plurality of panels 903 are composed of a material other than glass, such as wood, plastic, acoustic panels, white boards, or any other material. In addition, system 901 demonstrates the use of accessories such as lights 905 and shelves 907.

The system of the present invention provides for modular, upright panels to subdivide any flat work surface into smaller individual work areas. Due to the combination of hidden hardware, strong solid steel construction, and pre-drilled holes in the panels, any configuration or size of system can be created without drilling holes into the work surface. The strength of the panel connection system allows for many accessories to be added to create functional work areas to work in while never hurting the work surface. The primary use of glass as a panel divider allows for unrestricted light moving through the room while still creating separate space for individuals to work. The radius cornered structural elements of glass and steel along with other rigid panel types allow for a strong system that still has elegance in it's simplicity.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A table dividing system, comprising:

a connecting system to rest on a top surface of a table, the connecting system having:

a first bracket having:

a first section having a first portion and a second portion connected at approximately a 90 degree angle and further having a first foot extending perpendicular from the first portion and a second foot extending perpendicular from the second portion, the first foot and the second foot rest on the top surface of the table; and a second section wherein the first section and the second section include one or more pre-drilled holes; and one or more connectors configured to extend through the pre-drilled holes; wherein the first portion and the second portion secure to a panel such that the panel is secured between a first interior surface of the first section and a second interior surface of the second section; and wherein the panel is held above the top surface of the table.

2. The system of claim 1, wherein the first bracket is composed of steel.

3. The system of claim 1, further comprising:

the panel being composed of glass.

4. The system of claim 1, wherein the first foot and the second foot hold the panel above the top surface such that there is a gap between a bottom edge of the panel and the top surface.

5. The system of claim 1, wherein the connecting system further comprises a spacer configured to secure between the panel and the bracket.

* * * * *